US009155935B2

(12) United States Patent
Kelliher

(10) Patent No.: US 9,155,935 B2
(45) Date of Patent: Oct. 13, 2015

(54) GYROSCOPIC EXERCISE BALL

(75) Inventor: Timothy Kelliher, Alameda, CA (US)

(73) Assignee: MOVEA, Grenoble (FR)

( * ) Notice: Subject to any disclaimer, the term of this patent is extended or adjusted under 35 U.S.C. 154(b) by 528 days.

(21) Appl. No.: 13/514,827

(22) PCT Filed: Dec. 10, 2010

(86) PCT No.: PCT/EP2010/069343

§ 371 (c)(1),
(2), (4) Date: Aug. 15, 2012

(87) PCT Pub. No.: WO2011/070138

PCT Pub. Date: Jun. 16, 2011

(65) Prior Publication Data

US 2012/0302407 A1 Nov. 29, 2012

Related U.S. Application Data

(60) Provisional application No. 61/285,386, filed on Dec. 10, 2009.

(51) Int. Cl.

| | |
|---|---|
| ***A63B 24/00*** | (2006.01) |
| ***A63B 71/00*** | (2006.01) |
| ***A63B 23/14*** | (2006.01) |

(Continued)

(52) U.S. Cl.

CPC ..... *A63B 23/14* (2013.01); *A63B 21/22* (2013.01); *A63B 24/0006* (2013.01); *A63B 71/0622* (2013.01); *A63B 2021/222* (2013.01); *A63B 2024/0009* (2013.01); *A63B 2220/17* (2013.01); *A63B 2220/35* (2013.01); *A63B 2220/833* (2013.01)

(58) Field of Classification Search

CPC ..... A63B 23/14; A63B 23/035; A63B 23/12; A63B 23/16; A63B 21/22; A63B 21/0608; A63B 2021/222; A63B 24/0006

USPC ..... 482/8, 44–47, 49, 50, 6, 7, 9; 74/5.4, 74/5.47; 73/489, 495

See application file for complete search history.

(56) References Cited

U.S. PATENT DOCUMENTS 4,192,189 A * 3/1980 Presley ..... 73/504.03
5,150,625 A * 9/1992 Mishler ..... 74/5 R (Continued)

OTHER PUBLICATIONS

International Search Report dated May 16, 2011, issued in corresponding International Application No. PCT/EP2010/069343.

*Primary Examiner* — Oren Ginsberg
*Assistant Examiner* — Nyca T Nguyen
(74) *Attorney, Agent, or Firm* — Stroock & Stroock & Lavan LLP

(57) ABSTRACT

A gyroscopic exercise ball (10) includes a housing (10*a*, 10*b*) surrounding a rotor (12) centrally disposed on a shaft (14) having two ends (28) mounted in notches (26) of a freely rotatable gimbal ring (24). The ring and the ends of said shaft are disposed in a groove having a height larger than a diameter of the ends of the shaft. The diameter is larger than a thickness of the gimbal ring, and a rotation rate sensor (60) measures the rotor speed. A processor (110) is in communication with the rotation rate sensor to calculate an exercise evaluation. A pitch axis and a roll axis gyroscopic sensor (80, 70) are in communication with the processor. The exercise evaluation determines energy expenditure, force, power, angles or angular velocity of motion, range of motion, position, speed or trajectory of motion, and an evaluation of form for an individual exercise.

14 Claims, 6 Drawing Sheets

(51) Int. Cl.

| | |
|---|---|
| ***A63B 21/005*** | (2006.01) |
| ***A63B 21/22*** | (2006.01) |
| *A63B 71/06* | (2006.01) |

(56) References Cited

U.S. PATENT DOCUMENTS

| | | | | |
|---|---|---|---|---|
| 5,353,655 | A | 10/1994 | Mishler | |
| 5,386,738 | A * | 2/1995 | Havenhill | 74/5.22 |
| 5,800,311 | A * | 9/1998 | Chuang | 482/44 |
| 6,401,556 | B1 * | 6/2002 | Hamady | 74/5.34 |
| 6,527,675 | B1 * | 3/2003 | Yu | 482/44 |
| 6,623,405 | B2 * | 9/2003 | Chuang et al. | 482/44 |
| 7,101,315 | B2 * | 9/2006 | Chuang et al. | 482/44 |
| 7,846,066 | B1 * | 12/2010 | Chuang | 482/1 |
| 8,083,589 | B1 * | 12/2011 | Kavars et al. | 463/36 |
| 2002/0145077 | A1 * | 10/2002 | Shultz | 244/79 |
| 2003/0139256 | A1 | 7/2003 | Chuang et al. | |
| 2004/0253904 | A1 * | 12/2004 | Lin | 446/236 |
| 2006/0020177 | A1 * | 1/2006 | Seo et al. | 600/300 |
| 2010/0121228 | A1 * | 5/2010 | Stirling et al. | 600/595 |

* cited by examiner

GYROSCOPIC EXERCISE BALL

CROSS-REFERENCE TO RELATED APPLICATIONS

This application is a national phase application under 35 U.S.C §371 of PCT/EP2010/069343, filed Dec. 10, 2010, which claims priority to U.S. Patent Application No. 61/285,386, filed Dec. 10, 2009; the entire contents of which both of these applications are expressly incorporated herein by reference.

BACKGROUND

1. Field of the Invention

The present invention relates generally to exercise devices, and more specifically to a hand-held gyroscopic exercise ball.

2. Description of the Related Art

Gyroscopic exercise balls are hand-held devices used in therapy and strengthening exercises, primarily to exercise the hand and wrist. Such gyroscopic exercise balls are commercially available. Two such devices currently available are the DYNABEE and the POWERBALL available from Play Trend Exclusive Worldwide and Nano-second Technology Co., Ltd., respectively. U.S. Pat. No. 3,726,146 to Archie Mishler describes a gyroscopic exercise ball including a rotor which rotates about its spin axis and about a second axis at right angles to the spin axis, which rotor increases in speed by applying a torque about a third axis. This phenomenon is commonly referred to as precession.

Typically, a gyroscopic exercise ball includes a rotor centrally disposed on a shaft within a spherical housing. The housing almost fully encases the rotor except for a small circular opening through which a portion of the rotor extends in order to give the rotor an initial spin about its spin axis. The ends of the shaft are mounted in notches of a lightweight ring, or gimbal, which is disposed in a groove of the housing which circumferentially surrounds the rotor. The groove is wider than the diameter of the ends of the shaft and also allows the lightweight ring to spin therein. In response to an external torque, applied by the wrist, one end of the shaft rolls around the top edge of the groove while the other end rolls around the bottom edge as the lightweight ring rotates, thereby causing the rotor to speed up. As a general rule, the higher the applied torque, the faster the rotor will spin.

Recently, gyroscopic exercise balls have been provided with mechanisms for calculating the speed and/or number of revolutions of the rotor. One such device, described in U.S. Pat. Nos. 5,150,625 and 5,353,655 to Frederick Mishler, includes an optical device coupled with a counter for determining the speed of the rotor. The gyroscopic exercise ball also includes Light-Emitting Diodes (LEDs) which are powered by a power generating circuit within the spinning rotor. Other gyroscopic exercise balls are provided with a digital display and memory to display and store the speed of the rotor. These gyroscopic exercise balls can be plastic or metal, with increased weight of metal balls making the exercise more challenging by producing more torque.

The ability to calculate and display the speeds of the rotor have given users some indication of the relative intensity of their workout and allows users to compete against their own scores and the scores of others. However, the speed of the rotor does not provide an accurate representation of the intensity of the workout and can actually cause users to use improper and unsafe form to achieve higher speeds, thereby increasing susceptibility to injury, such as a torn muscle or ligament. Thus, knowledge of rotor speed is not sufficient to assess the impact of the exercise.

Therefore, what is needed is a gyroscopic exercise ball which provides a more accurate representation of the intensity of a workout and which allows for a better evaluation of the exercise.

To accurately assess the exercise quantitatively and determine whether the exercise is providing the proper therapeutic or strengthening benefit, it is useful to measure, inter alia, the forces applied by the user, the amount of calories expended, the range of motion and the degree to which the exercise is being performed to an optimal form. The gyroscopic exercise balls currently available do not provide such functionality, and consequently, there is no way to assess an individual's exercise.

SUMMARY

In an embodiment, the present invention provides a gyroscopic exercise ball having a housing which surrounds a rotor centrally disposed on a shaft having two ends which are mounted in notches of a freely rotatable gimbal ring. The ring and the ends of the shaft are disposed in a groove, the groove having a height which is larger than a diameter of the ends of the shaft which, in turn, is larger than a thickness of the gimbal ring. The gyroscopic exercise ball includes a first gyroscopic sensor oriented on a pitch axis of the gyroscopic exercise ball and a second gyroscopic sensor oriented on a roll axis of the gyroscopic exercise ball, the pitch and roll axes being at angles to one another. A rotation rate sensor measures the speed of the rotor and at least two proximity sensors are provided to determine a distance to the rotor. The gyroscopic sensors, rotation rate sensor and proximity sensors communicate with a processor configured to calculate an exercise evaluation including at least one of an energy expenditure, a force, a power, angles or angular velocity of motion, a range of motion, position, speed or trajectory of motion, and an evaluation of form for an individual exercise. The exercise evaluation is displayed on a monitor mounted on the housing and coupled with the processor.

BRIEF DESCRIPTION OF THE DRAWINGS

The foregoing and other features of the present invention will be more readily apparent from the following detailed description and drawings of illustrative embodiments of the invention in which.

DETAILED DESCRIPTION

Figure 1:
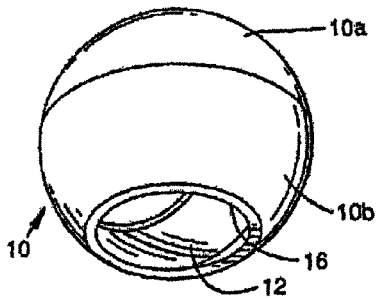
FIG. 1 is a perspective view of a conventional gyroscopic exercise ball showing the general construction thereof.
Figure 2:
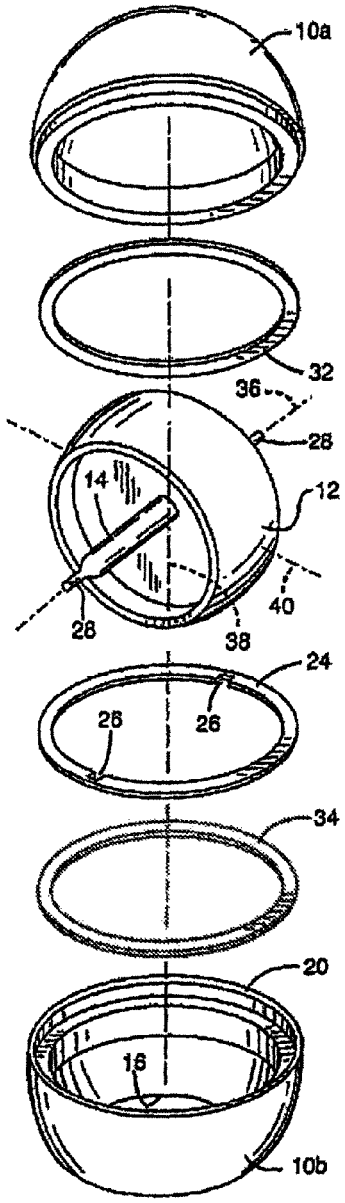
FIG. 2 is an exploded view of the conventional gyroscopic exercise ball of FIG. 1 showing the internal components thereof.

Referring to FIGS. 1 and 2, the general construction of a gyroscopic exercise ball 10 is illustrated for exemplary purposes. The gyroscopic exercise ball 10 includes a rotor 12 disposed between an upper housing 10*a* and a lower housing 10*b*. The rotor 12 is centrally disposed on a shaft 14 having two ends 28 mounted in notches 26 of a lightweight gimbal ring 24. The diameter of the shaft ends 28 is larger than the thickness of the gimbal ring 24, but slightly smaller than the height of an annular groove which may be formed, e.g., by a space between opposed lining portions 32, 34 disposed on each side of stepped-up portion 20. The gimbal ring 24 is thereby freely rotatable within the groove. Additionally, first and second shaft ends 28 are thereby able to roll on the upper and lower surfaces of the groove, respectively, as precession occurs along the precession axis 38. Since friction is required for the shaft ends 28 to roll on the surfaces of the groove and speed up the rotor, the internal surfaces of the groove, e.g., the lining portions 32, 34, have a static coefficient of friction which may be in the range of 1.3 to 0.73 and a dynamic coefficient of friction which may be in the range of 0.69 to 0.54. The lower housing 10*b* includes an open end 16 through which a portion of the rotor 12 extends for providing the rotor 12 with an initial spin about the spin axis.

FIGS. 1 and 2 merely illustrate a possible construction for a gyroscopic exercise ball 10. Other gyroscopic exercise balls 10 having various different constructions are equally applicable to the present invention. Such gyroscopic exercise balls 10 may be used for physical therapy, e.g., to help a patient recover from a wrist injury. Alternatively, they may be used to increase the strength of the wrist and/or to train the muscles of the wrist to follow a precise motion. This is especially advantageous for athletes competing in sports where wrist strength and/or motion can be a factor, such as rock climbers, baseball players, bowlers, rowers, tennis players, etc. Moreover, the gyroscopic exercise balls 10 can be used as part of a game with users competing to see who can achieve the highest speed, maximum force, largest or smallest range of motion, most optimal form, etc in accordance with the present invention as set forth below. Of course, the gyroscopic exercise balls 10 can also be used for the mere purpose of burning calories as well.

Figure 3:
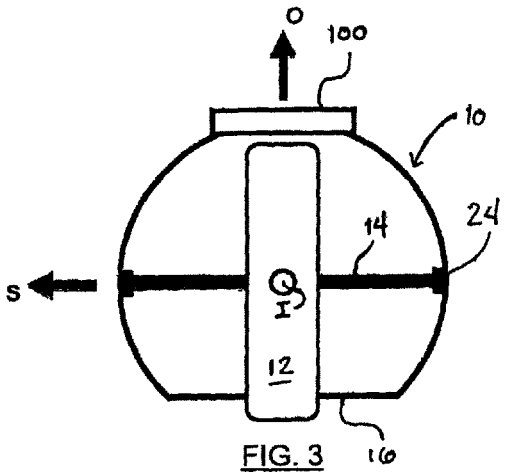
FIG. 3 is a cross-sectional view of a gyroscopic exercise ball according to an embodiment of the present invention taken in the plane of the spin and output axes.
Figure 4:
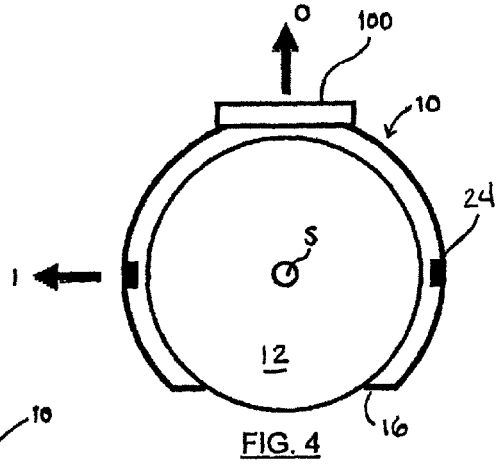
FIG. 4 is a cross-sectional view of a gyroscopic exercise ball according to an embodiment of the present invention taken in the plane of the input and output axes.
Figure 5:
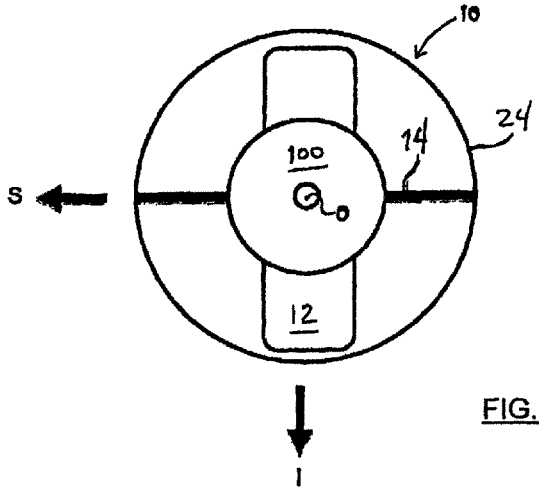
FIG. 5 is a cross-sectional view of a gyroscopic exercise ball according to an embodiment of the present invention taken in the plane of the spin and input axes.

Referring to FIGS. 3-5, a monitor 100 is shown mounted to a gyroscopic exercise ball 10. The monitor 100 may be integrally or detachably connected (e.g., by clips) to a gyroscopic exercise ball 10 especially designed for the monitor 100. Alternatively, the monitor 100 is an add-on component to a pre-existing gyroscopic exercise ball 10, preferably being a replacement for an existing digital display of various gyroscopic exercise balls 10. In accordance with such a configuration, the monitor 100 is adaptable to any type of gyroscopic exercise ball 10, regardless of its construction.

The monitor 100 is mounted along the output axis O (i.e., the precession axis), preferably at the top of the gyroscopic exercise ball 10, and parallel to the plane of the input axis I and the spin axis S. The rotor 12 spins with the integrally formed shaft 14 about the spin axis S and the gimbal ring 24 is freely rotatable about the output axis O. A user of the gyroscopic exercise ball 10 gives the rotor 12 an initial spin, e.g., by pulling a cord attached thereto or by rolling the rotor 12 across a flat surface through the open end 16. Once the rotor 12 is spinning, the user applies a torque by motion of their wrist along the input axis I, thereby causing precession about the output axis O. Through the continuous application of force along the input axis I (i.e., rotational motion of the wrist), the user speeds up the rotor 12 and, of course, exercises their hand and wrist. As the rotor 12 increases in speed, the counter-forces on a user's wrist also increase, thus making the exercise more intense.

Figure 6:
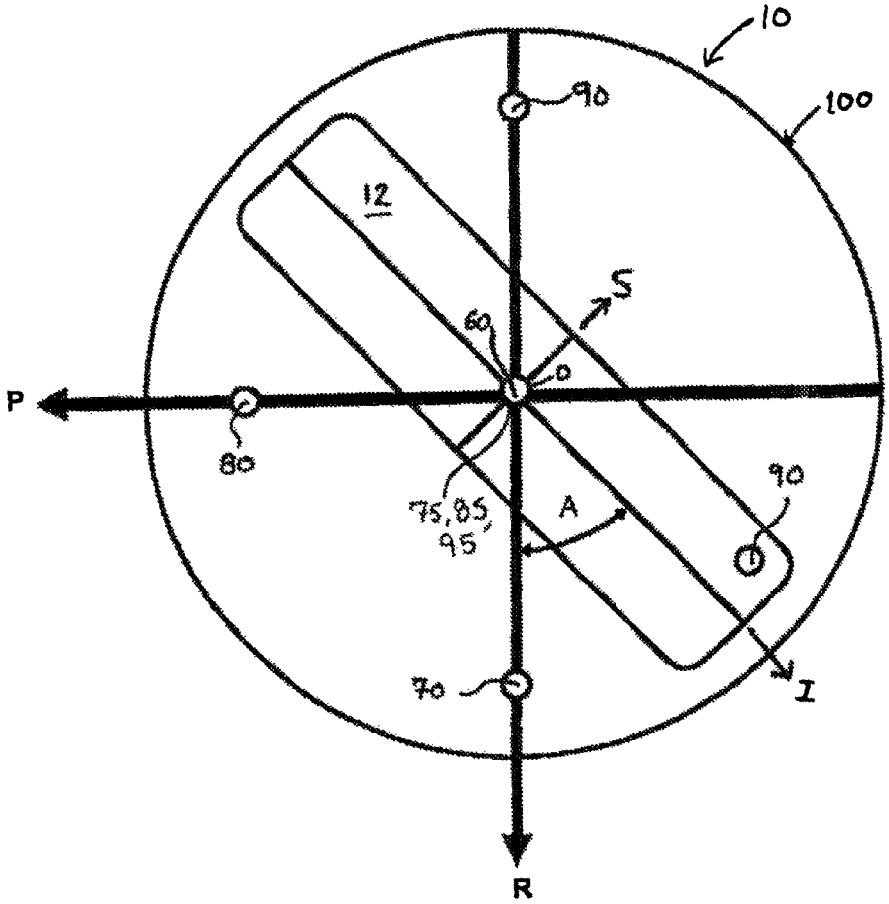
FIG. 6 is a cross-sectional view of a gyroscopic exercise ball according to an embodiment of the present invention taken in the plane of the pitch and roll axes showing the relative positions of sensors with respect to the rotor.
Figure 7:
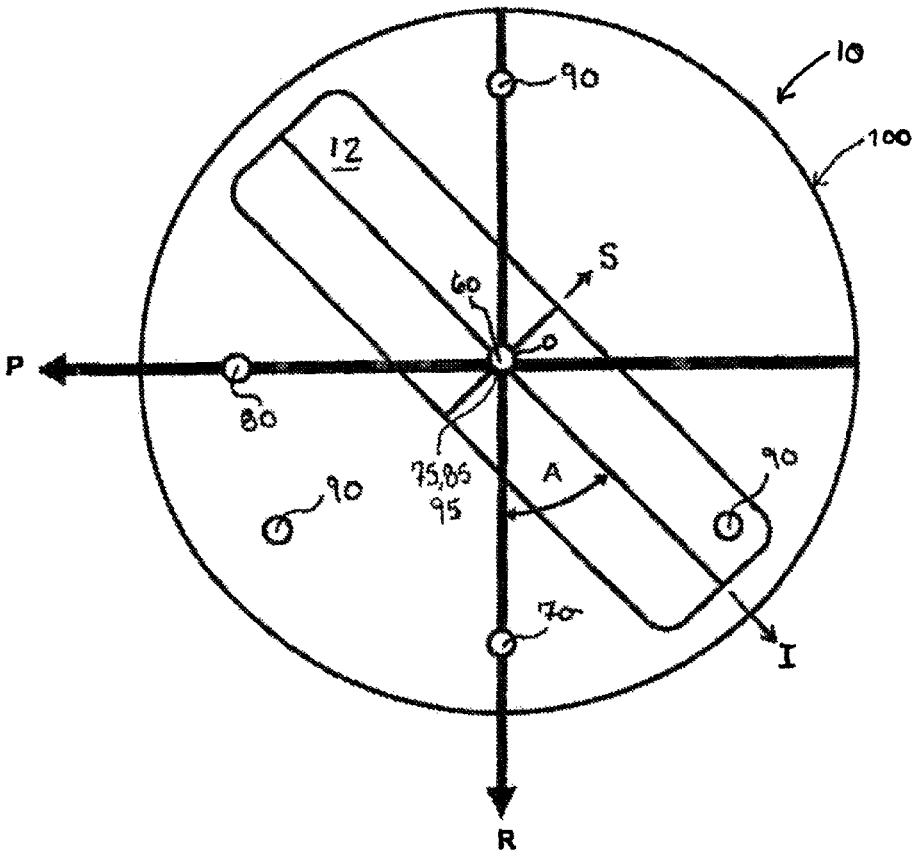
FIG. 7 is a cross-sectional view of a gyroscopic exercise ball according to another embodiment of the present invention taken in the plane of the pitch and roll axes showing the relative positions of sensors with respect to the rotor.

Referring to FIGS. 6 and 7, the relative positions of a plurality of sensors 60, 70, 80, 90 are shown with respect to a rotor 12 of a gyroscopic exercise ball 10, in a plane of pitch axis P and roll axis R at a right angle thereto. The pitch and roll axes P, R are offset from the spin and input axes by 45 degrees.

A rotation rate sensor 60, which can be disposed anywhere with respect to the rotor 12, but is preferably disposed directly above the rotor 12, measures the speed of the rotor 12 about the spin axis. The rotation rate sensor 60 is preferably either an optical or magnetic field sensor which generates electronic pulses for every revolution of the rotor 12. For example, an optical sensor may be provided facing the rolling surface of the rotor 12 having an optical aberration thereon such that light ceases to be reflected once per revolution. By counting the number of pulses over a measured time period (e.g., using a counter), the speed of the rotor 12 in revolutions per minute (RPM) can be determined.

A roll sensor 70 is disposed along the roll axis R and a pitch sensor 80 is disposed along the pitch axis P. The pitch and roll axes P, R are provided at angles to one another (i.e., non-parallel axes), preferably right angles. Preferably, the pitch and roll sensors 80, 70 are gyroscopic sensors, such as the microelectromechanical systems (MEMS) gyroscopic pitch and roll sensors, e.g., model IDG-650, available from InvenSense, Inc. or gyro-sensor model XV-3500CB available from Seiko Epson Corporation. When properly oriented along the pitch and roll axes P, R the gyroscopic sensors measure and output the change in angle of the gyroscopic exercise ball 10 over a unit time. By knowing the time necessary to complete a full revolution about each of the pitch and roll axes P, R, the period of revolution of the gyroscopic exercise ball 10 can be determined and multiplied by the angular pitch and roll velocity to determine a range of motion for the gyroscopic exercise ball 10. In one embodiment, either one of the roll sensor 70 and the pitch sensor 80 is provided alone. By using a single gyroscopic sensor to measure either of the pitch and pitch velocity or the roll and roll velocity, the other values can be estimated by assuming that the motion is consistent about each axis. Preferably, both the roll sensor 70 and pitch sensor 80 are provided to obtain a more accurate representation of the motion.

In an embodiment, in addition to the pitch and roll sensors 80, 70, a third gyroscopic sensor 75 may be disposed at angles, for example, right angles, to the pitch and roll axes P, R. The third gyroscopic sensor 75 may be provided in the embodiments of FIGS. 6 and 7 to measure the rate of movement about a third axis, for example, the yaw axis by positioning the third gyroscopic sensor 75 relative to the third axis of the orthonormal frame of reference, wherein the pitch and roll axes P, R are the first and second axes. In this embodiment, the rotation sensor 60 and gyroscopic sensors 70, 75, 80 may be used to measure the three rotation rates of the gyroscopic exercise ball 10 about the respective yaw, pitch and roll axes.

In another embodiment, in addition to the gyroscopic sensors, the gyroscopic exercise ball 10 includes a 3-axis accelerometer 85 that measures the acceleration from motion of the gyroscopic exercise ball, as well as the gravitational field, thereby providing information relative to a horizontal plane. In combination, the gyroscopic sensors 70, 75, 80 and the accelerometer 85 may be used to provide an absolute measurement of the tilt orientation (i.e., relative to the horizontal plane) of the gyroscopic exercise ball 10 in an absolute frame of reference. Using the measured orientation, the 3-dimensional trajectory of the gyroscopic exercise ball 10 may be estimated and transmitted to the monitor 100 or an external display so that the user is provided feedback about the exercise. For example, algorithms described in International Patent Application No. PCT/EP2009/105922 (published as WO2010/007160), which is hereby incorporated by reference in its entirety, may be used to calculate the orientation and/or trajectory. Further, the trajectories for different exercises may be compared to provide additional details about the workout. As described in further detail below, the gyroscopic exercise ball 10 may be directly or indirectly connected to a remote device or display, such as a personal computer 150. The personal computer 150 may display trajectories for different exercises and/or may compare them to provide additional details about the workout. For example, a user may move a pointer on the screen of the personal computer 150 in two dimensions to provide feedback of the exercise he is doing and compare it to a prior or preset exercise.

Referring to FIGS. 6 and 7, by way of example only, the accelerometer 85 may be disposed proximal to the rotation rate sensor 60, underneath the display 100. For this application, it is advantageous to select accelerometers of the MEMS type which have a small form factor, low power consumption and a low cost, for example, micro accelerometers marketed by KIONIX (such as model no. KXPA4 3628). Other such devices are available from STM, FREESCALE or ANALOG DEVICE.

Since the gyroscopic sensors 70, 75, 80 and the accelerometer 85 do not measure the yaw in an absolute manner, it is difficult to accurately compute an absolute orientation of the gyroscopic exercise ball 10. Accordingly, in a further embodiment of the gyroscopic exercise ball 10, one or more 3-axis magnetic field sensors 95 are provided so that the absolute orientation of the exercise ball can be computed from the gyroscopic sensors 70, 75, 80, the accelerometer 85 and the magnetic sensors 95. The magnetic sensors 95 can be perturbed by internal magnetic perturbations if an internal component of the gyroscopic exercise ball 10 is magnetic and moving relative to the magnetic sensors 95. Likewise, the rotation rate sensor 60 and/or proximity sensors 90 may be used to compute the internal magnetic perturbations, thus enabling the use of a magnetometer to determine the absolute orientation of the gyroscopic exercise ball 10 in the reference frame. A three-dimensional trajectory having the absolute orientation in the reference frame may then be displayed, as above, on the monitor 100 or, preferably, through an external display, such as the monitor of a personal computer 150 linked directly or indirectly to the gyroscopic exercise ball 10.

Referring to FIGS. 6 and 7, in an alternative embodiment of the invention and by way of example only, a magnetic sensor 95 is disposed proximal to the rotation rate sensor 60 and the three axes accelerometer 85, underneath the display 100. For this application, it is advantageous to use magnetometers of the MEMS type for the magnetic sensor 95 since they have a small form factor, low power consumption and a low cost. Examples of MEMS magnetometers include those marketed by HONEYWELL (e.g., model no. HMC1041Z for the vertical channel and model no. HMC1042L for the 2 horizontal channels). Other suitable devices are available from MEMSIC or ASAHI KASEI. The 3-D trajectory of the exercise ball 10 may be computed from the output of the pitch, roll and/or third gyroscopic sensors 80, 70, 75, the accelerometer 85 and the magnetic sensor 95 as described, for example, in International Patent Application published under No. WO2010/007160. This application discloses a method wherein, in a device comprising rate sensors, accelerometers and magnetometers, a perturbation of at least one of the measures of the sensors is detected and said measures are pre-processed and an operator is applied to said pre-processed answers to determine an orientation of said device. Accordingly, an estimate of the 3-D trajectory of the gyroscopic exercise ball 10 may be provided, thus allowing the a user to obtain feed-back on his exercise via a screen for instance, as described further below.

The measurements of the magnetic sensors 95 can be trumped by internal magnetic perturbations if an inside part of the exercise ball is magnetic and moving related to the magnetometer. The rotation rate sensor 60 and/or measurements from proximity sensors 90 can be used to determine the internal magnetic perturbations, thus enabling computation of the absolute orientation of the exercise ball in the reference frame, using one of the algorithms described, for example, in International Patent Application published under WO2010/007160 mentioned above.

A rotor position sensor, which may be formed by a plurality of proximity sensors 90, is provided for determining an angular position A of the rotor 12 at any given point in time. Each of the proximity sensors 90 measures a distance to the rotor 12. By knowing the relative positions of the proximity sensors 90 and the relative distances to the rotor 12, the angular position A of the rotor 12 can be determined. The type of sensor used as proximity sensors 90 may be analogue, capacitive, magnetic, laser or the like. For example, analogue magnetic proximity sensors produced by AKM Semiconductor, such as model HZ-1 16C or similar sensors may be used as proximity sensors 90. Alternatively, capacitive sensors formed from electrodes may be combined with controller model CY3271 by Cypress Semiconductor Corporation.

FIG. 6 illustrates an embodiment implementing two proximity sensors 90 and FIG. 7 illustrates an embodiment implementing three proximity sensors 90. However, it is noted that any number of proximity sensors 90 above two may be used to triangulate the angular position A of the rotor 12. Further, it does not matter where the proximity sensors 90 are mounted with respect to the rotor 12 so long as their positions with respect to one another are known.

Figure 8:
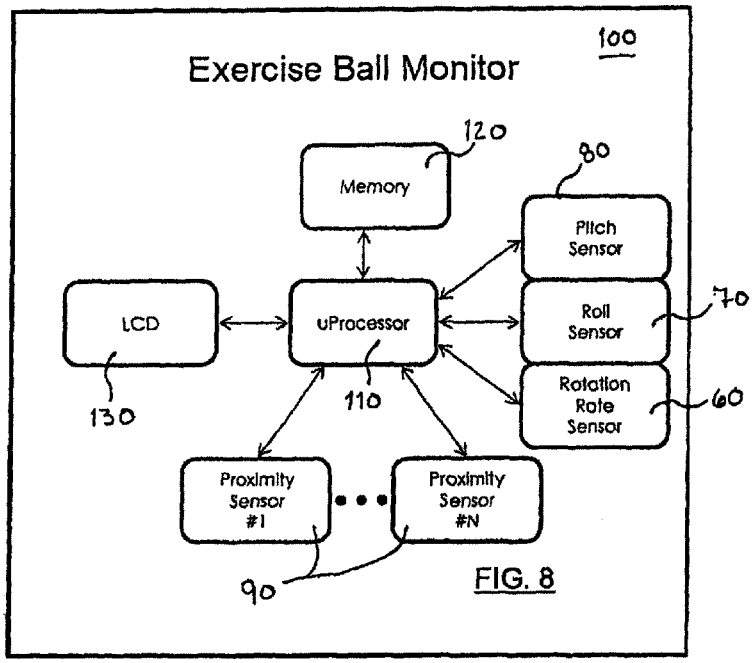
FIG. 8 is a schematic block diagram of the monitor for a gyroscopic exercise ball according to an embodiment the present invention.
Figure 9:
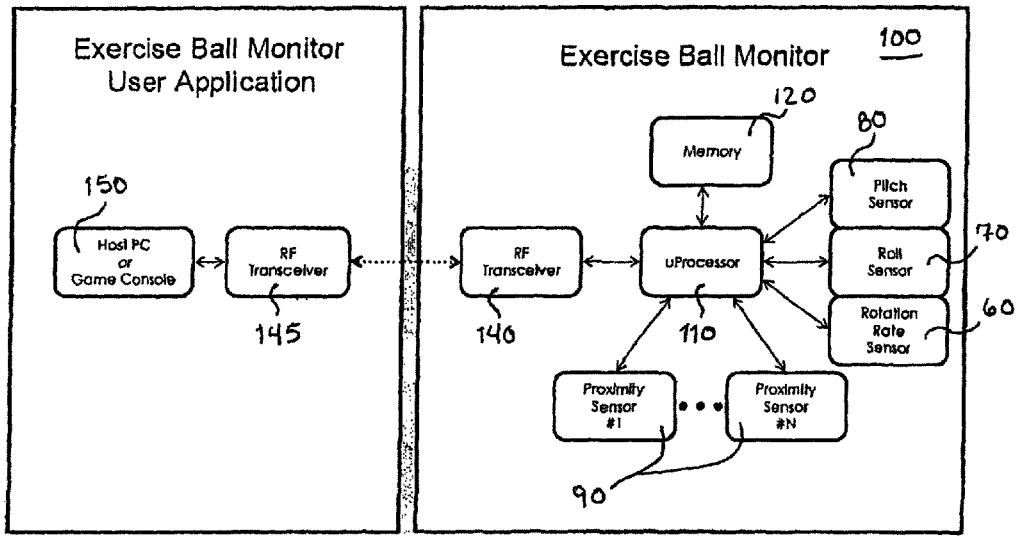
FIG. 9 is a schematic block diagram of the monitor for a gyroscopic exercise ball according to another embodiment the present invention.

Referring to FIGS. 8 and 9, schematic block diagrams show the functions and configuration of the monitor 100. A processor 110 is functionally coupled to the rotation rate sensor 60, the roll sensor 70, the pitch sensor 80 and proximity sensors 90 for continuously or intermittently receiving data therefrom. Specifically, the rotation rate sensor 60 provides the speed of the rotor 12. The roll sensor 70 provides the angular roll and angular roll velocity of the gyroscopic exercise ball 10. Similarly, the pitch sensor 80 provides the angular pitch and angular pitch velocity of the gyroscopic exercise ball 10. Lastly, the proximity sensors 90 provide the angular position A of the rotor 12.

The processor 110 may be, e.g., from the INTEL 8051 family of processors. Such a processor provides memory 120, on-chip as both data and program memory, and a Boolean processing engine for computing an exercise evaluation from the sensor output. By allowing computer processing from sensor output, memory and counters, the 8051 processor can be configured to compute and output the exercise evaluation.

Since a gyroscopic exercise ball 10 is based on the principles of angular momentum exhibited in a gyroscope with a single gimbal, knowledge of the foregoing six metrics (speed of the rotor 12, angular position A of the rotor 12, angular pitch of the ball 10, angular pitch velocity of the ball 10, angular roll of the ball 10 and angular roll velocity of the ball 10) combined with knowledge of the physical properties of the rotor 12 (size and mass) allows for the ability to measure and calculate an evaluation of the exercise including caloric expenditure, maximum force, range of motion and an evaluation of form. According to the principles of angular momentum, the torque applied by the user over an incremental unit of time can be determined in accordance with the following formula:

Wherein T and L are vectors of the torque on the gyroscopic exercise ball 10 and its angular momentum, respectively. The scalar component I is the moment of inertia of the gyroscopic exercise ball 10 and vector w is its angular velocity. Vector a is the angular acceleration of the gyroscopic exercise ball 10.

A torque T applied perpendicular to the axis of rotation, and therefore perpendicular to the angular momentum L, results in a rotation about an axis perpendicular to both T and L; this is due to the phenomenon described above known as precession. The angular velocity of precession fip may then be determined from the following cross-product:

Knowing the torque, the force can also be determined by dividing by the radius of the gyroscopic exercise ball 10. The distance travelled by the gyroscopic exercise ball 10 during the exercise may be determined integrating the pitch and roll velocities over time and a range of motion may be determined by the maximum and minimum of the rotational distance. Further, by multiplying the force exerted over the incremental unit of time by the distance travelled by the gyroscopic exercise ball 10 during that same period, and summing throughout the exercise, a user's caloric expenditure can be tracked throughout the exercise.

The higher the sampling rate, or the incremental unit of time at which measurements are taken, the more accurate representation of the exercise may be obtained. Typically, the rotor 12 rotates about the gimbal ring 24 less than 10 times per second. Thus, a substantially accurate representation of force can be determined by sampling once for each degree of rotation (i.e., 360 times per rotation). Preferably, the sampling rate is provided between 450 Hz (one sample per every 45" of rotation) and 3.6 KHz (one sample for each degree of rotation).

Each time the force is calculated, the processor 110 commits the value to one or more databases of the memory 120. The memory 120, in turn, may be configured to store each exercise profile separately or in temporary storage which is cleared each time a new exercise commences. In either case, the memory 120 records and stores values for the metrics during the course of the workout which are used by the processor 110 in calculating the exercise evaluation. Once the exercise is complete, the processor 110 searches the force values stored in the memory 120 for the exercise and either displays this value as the maximum force achieved on the display 130 (FIG. 8) and/or transmits it to a remote computing device 150 via radio-frequency (RF) transceivers 140, 145 (FIG. 9).

The processor 110 is also configured to determine an evaluation of form by combining the range of motion and caloric expenditure data for a particular exercise and comparing them against an optimal form where one of the two metrics is held constant and the other is calculated. The difference between the optimal value and actual value for each metric can then be displayed.

Accordingly, the processor 110 is configured to determine an exercise evaluation consisting of the caloric expenditure, a maximum force, a range of motion and an evaluation of form. However, these exercise evaluations can also be customized to fit various exercise routines or profiles and/or to provide users with more or less information about an individual exercise. For example, a particular user may not be interested to know the maximum force achieved based on their purpose for using the device (e.g., used for mild therapy), but would like to know that forces were maintained within a particular range throughout the exercise. In such a case, the user could select to display a range of forces, prompting the processor 110 to search the memory 120 for a minimum and maximum value for force and display the same. The selection means communicating with the processor 110 may be, e.g., buttons provided on the monitor 100 corresponding to certain logic functions of the processor 110 and/or a touch-screen provided as the display 130.

The sensors 60, 70, 80, 90 are preferably mounted on the surface of a printed circuit board (PCB) having electrical leads to the appropriate inputs of the processor 110. This PCB may be, e.g., disposed on a bottom face of the monitor 100 or to an internal surface of the housing of the gyroscopic exercise ball 10. Preferably, the processor 110 and memory 120 are contained within the monitor 100. The liquid-crystal display (LCD) 130 or other display means (FIG. 8) and/or the RF transceiver 140 or other signal means (FIG. 9) are disposed on the top surface of the monitor 100. In the embodiment shown in FIG. 8, the RF transceiver 140 of the monitor 100 communicates remotely with a host personal computer (PC) or game console 150 for storing, saving and/or further evaluating the exercise evaluation.

The exercise evaluation can be displayed (FIG. 8) and/or transmitted (FIG. 9) continuously, intermittently, at the end of each exercise and/or at the request of the user. Preferably, the exercise evaluation is displayed at least at the end of each exercise or every time the user takes a break so that they may adjust the exercise accordingly. In the embodiment show in FIG. 9, however, the exercise evaluation can be transmitted intermittently during the workout so that it may be displayed to the user and/or a trainer so that adjustments to the exercise can be made on the fly. In addition to being displayed to the user, the exercise evaluations may also be permanently stored in the memory 120 or on the host PC or game console 150 so that past exercises can be accessed. This is particularly advantageous when attempting to gauge improvements in strength and form gained by using the gyroscopic exercise ball 10 over a particular training regimen (be it for days, weeks, months, months or years). For example, one or more of the algorithms described in International Patent Application published under No. WO2009/156499, may be used for the exercise evaluation. This application discloses a method wherein, in a device comprising a rate sensor and an accelerometer, movements of said pointing device are converted into movements of a cursor in a plane using a nonlinear data fusion algorithm.

Figure 10:
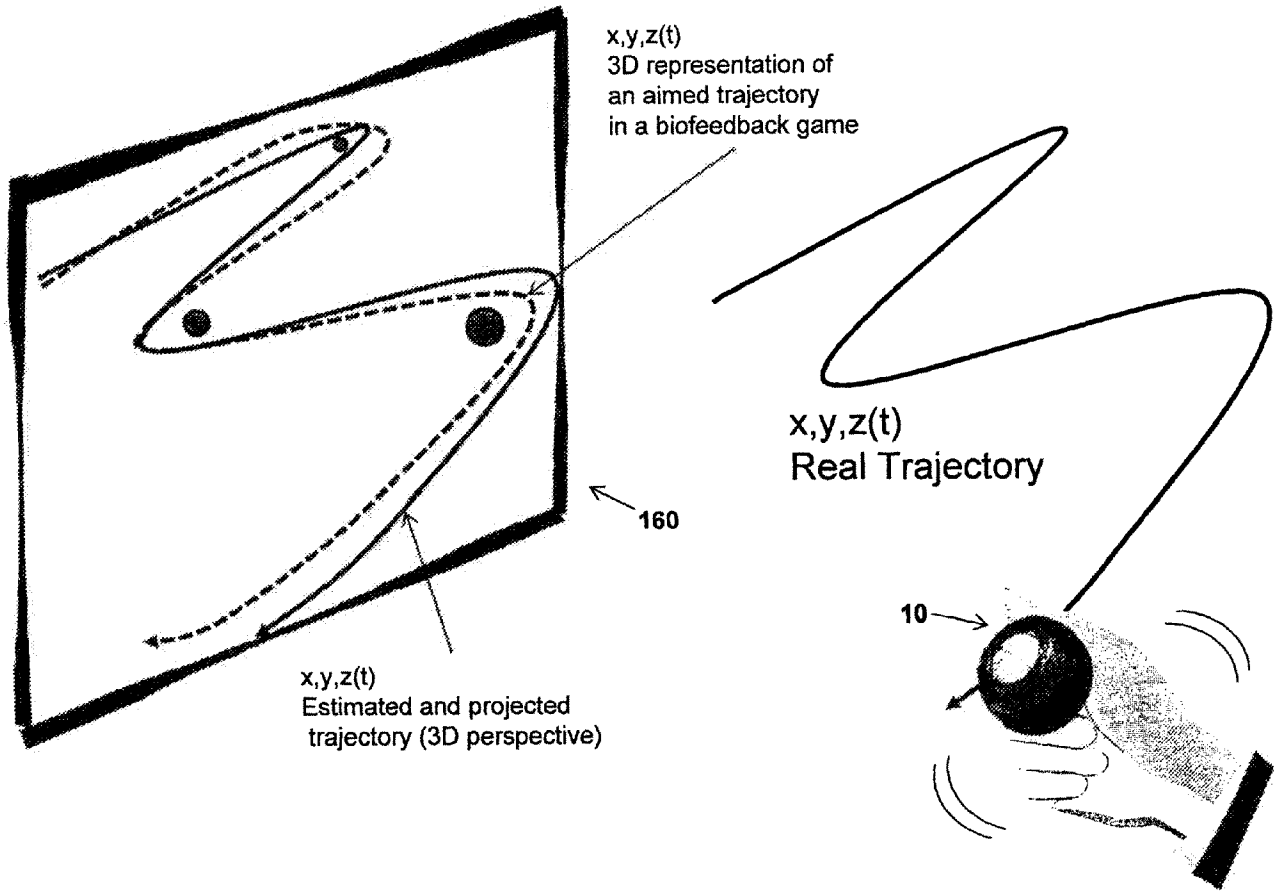
FIG. 10 is a representative view of a user of the gyroscopic exercise ball according to an embodiment of the present invention having a display for trajectory.

Referring to FIG. 10, the gyroscopic exercise ball 10 is connected to a display 160 where a cursor converts its 3-D movements into 2-D movements of the cursor. For example, the signals of the sensors may be sent by an RF transmitter to the base station. The RF transmitter can use a Bluetooth or an 802.x waveform and a specific protocol optimized to minimize power consumption. A controller on the base station then converts the signals into cursor 2-D movements using matrix conversion which may include roll compensation algorithms of the type described in WO2009/156499 mentioned above, or in PCT application published under no. WO2009/156476. This latter application discloses a method wherein, in a device comprising two rate sensors and two accelerometers, an algebraic transform is applied to the output of the rate sensors from the output of the accelerometers to produce a movement of a cursor on a screen which is compensated for the roll of the device. The same 2-D screen or display 160 on which the cursor movements appear may display exercise sequences that the user has to mimic. The user may then compare visually his performance to the exercise sequences in real time. Further, the visual comparison may be advantageously supplemented by a comparison of indexes of his actual performance to indexes of the exercise sequence.

While the invention has been particularly shown and described with reference to preferred embodiments thereof, it will be understood by those skilled in the art that various changes in form and details may be made therein without departing from the spirit and scope of the invention.

The claimed invention is:

1. A gyroscopic exercise ball having a spin axis, a pitch axis and a roll axis, said gyroscopic exercise ball comprising:

a housing surrounding a rotor centrally disposed on a shaft having two ends mounted in notches of a freely rotatable gimbal ring, wherein said ring and the ends of said shaft are disposed in a groove having a height larger than a diameter of the ends of the shaft, said diameter being larger than a thickness of the gimbal ring, at least a rotation rate sensor for measuring the rotor speed, and a processor in communication with said rotation rate sensor, said processor being configured to calculate an exercise evaluation, said gyroscopic exercise ball further comprising a gyroscopic sensor positioned on at least one of the pitch axis and the roll axis to measure a change in angle of said gyroscopic exercise ball, said gyroscopic sensor configured to provide output to said processor for the exercise evaluation, the exercise evaluation comprising at least one of an energy expenditure, a force, a power, and an evaluation of form for an individual exercise.

2. The gyroscopic exercise ball of claim 1, further comprising at least one three axis field sensor for measuring one of earth gravitational and magnetic fields.

3. The gyroscopic exercise ball of claim 2, wherein the the at least one gyroscopic sensor gyroscopic sensor and the at least one field sensor are used in combination to provide a 3-dimensional orientation of the gyroscopic exercise ball in an absolute frame of reference.

4. The gyroscopic exercise ball of claim 3, wherein an output of a second field sensor for measuring a field different from a field measured by the first field sensor, is combined with the output of the first field sensor and the output of said the at least one gyroscopic sensor gyroscopic sensor for providing a 3-dimensional orientation of the gyroscopic exercise ball in an absolute frame of reference.

5. The gyroscopic exercise ball of any of claim 3, wherein the 3-dimensional orientation of the gyroscopic exercise ball is used to estimate a 3-dimensional trajectory of the gyroscopic exercise ball, said trajectory being transmitted to a monitor or to an external display.

6. The gyroscopic exercise ball of claim 5, wherein trajectories from different exercises are compared to provide additional details about a workout from the different exercises.

7. The gyroscopic exercise ball of claim 2, wherein said at least one field sensor is disposed proximal to the at least one rotation rate sensor, and underneath a display.

8. The gyroscopic exercise ball of claim 1, wherein values of a norm of a force vector applied to said exercise ball are calculated and stored in a memory at a given frequency as a result of a division of a torque vector applied by a radius of the exercise ball, said torque vector being calculated as a product of the exercise ball angular velocity vector by its moment of inertia.

9. The gyroscopic exercise ball of claim 8, wherein caloric expenditure of a user during a unit of time is calculated and stored in said memory according to a product of the force applied and a distance travelled by the exercise ball over said unit of time, said distance travelled being itself determined by integrating pitch and roll velocities over said unit of time.

10. The gyroscopic exercise ball of claim 1, further comprising at least two proximity sensors for determining a distance of said proximity sensors to the rotor.

11. The gyroscopic exercise ball of claim 1, further comprising a monitor mounted on said housing and coupled to said processor to display said exercise evaluation.

12. The gyroscopic exercise ball of claim 1, wherein a lower housing of said housing includes an open end through which a portion of the rotor extends for providing the rotor with an initial spin about a spin axis.

13. The gyroscopic exercise ball of claim 1, wherein the at least one rotation sensor is one of an optical or magnetic sensor which generates electronic pulses for every revolution of the rotor.

14. The gyroscopic exercise ball of claim 1, further comprising a yaw axis gyroscopic sensor.

* * * * *